US009017514B2

(12) United States Patent
Borrero

(10) Patent No.: US 9,017,514 B2
(45) Date of Patent: Apr. 28, 2015

(54) METHOD TO PRODUCE HIGH-RESISTANCE CELLULOSE AND HEMICELLULOSE FIBERS FROM LIGNOCELLULOSIC BIOMASS OF SUGARCANE LEAVES AND BUDS

(75) Inventor: Jorge Humberto Borrero, Santiago de Cali (CO)

(73) Assignee: Universidad del Valle, Santiago de Cali (CO)

( * ) Notice: Subject to any disclaimer, the term of this patent is extended or adjusted under 35 U.S.C. 154(b) by 0 days.

(21) Appl. No.: 14/131,740

(22) PCT Filed: Jul. 4, 2012

(86) PCT No.: PCT/IB2012/053393

§ 371 (c)(1),
(2), (4) Date: Jan. 9, 2014

(87) PCT Pub. No.: WO2013/008135

PCT Pub. Date: Jan. 17, 2013

(65) Prior Publication Data

US 2014/0166220 A1 Jun. 19, 2014

(30) Foreign Application Priority Data

Jul. 12, 2011 (CO) ..... 11-86711

(51) Int. Cl.
*D21H 11/12* (2006.01)
*D21C 3/20* (2006.01)
(Continued)

(52) U.S. Cl.
CPC .. *D21C 3/20* (2013.01); *D21C 3/02* (2013.01); *D21C 3/222* (2013.01); *D21H 11/12* (2013.01); *D21B 1/30* (2013.01)

(58) Field of Classification Search
CPC ..... D21C 3/003; D21C 3/20; D21H 11/12
USPC ..... 162/70, 96, 99
See application file for complete search history.

(56) References Cited

U.S. PATENT DOCUMENTS

| | | | |
|---|---|---|---|
| 4,956,048 | A | 9/1990 | Hise |
| 5,531,865 | A | 7/1996 | Cole |
| 2010/0190973 | A1 | 7/2010 | Srivastava et al. |

FOREIGN PATENT DOCUMENTS

| | | |
|---|---|---|
| EP | 0716182 | 6/1996 |
| JP | 4046935 | 2/1992 |
| WO | 2010060183 | 6/2010 |

OTHER PUBLICATIONS

Biotechnology in the Pulp and Paper Industry, The Third International Conference, Stockholm Jun. 16-19, 1986.

(Continued)

*Primary Examiner* — Anthony Calandra
(74) *Attorney, Agent, or Firm* — Maryellen Feehery Hank; Reed Smith LLP

(57) ABSTRACT

Method for production of cellulose and hemicellulose fibers from lignocellulose biomass obtained from sugarcane leaves and buds by applying a process comprising the stages of: a) Diminishing the particle size of the lignocellulose biomass to a range between 3 and 15 mm, b) Subjecting the product obtained to treatment with one or more solvents and/or a mixture of specific catalysts, c) Carry out sudden decompression to an atmospheric pressure, d) Collecting the pretreated material in a cyclone, e) Optionally separating the liquid and solid fractions through washing and filterung f) Optionally, treating the solid fraction in a reactor with a mixture of ethanol and chlorine dioxide, d) Wash the product obtained to achieve cellulose efficiency above 50% and of lignin of 5 to 7%, fiber lengtht in a range to 1,5 to 2,7 mm, breaking length (km) of 7,0 -8,9, Burst index ($kPam^2/g$) of 4,5-7,2 and Tear index ($mNm^2/g$) of 8,2-8, The obtained high-resistance cellulose and hemicellulose is especially suitable for the paper production and polymer-type plastics.

15 Claims, 1 Drawing Sheet

(a) (b)

(51) Int. Cl.

| | |
|---|---|
| ***D21C 3/02*** | (2006.01) |
| ***D21C 3/22*** | (2006.01) |
| ***D21B 1/30*** | (2006.01) |

(56) References Cited

OTHER PUBLICATIONS

Goncalves, et al. "Integrated Processes for Use of Pulps and Lignins Obtained From Sugancane Bagasse and Straw: a Review of Recent Efforts in Brazil." Appl. Biochem. Biotechnol. 2005, Spring, 121-124: 821-6.
Canilha, et al. "Bioconversion of Sugarcane Biomass Into Ethanol: An Overview About Compositino, Pretreatment Methods, Detoxification of Hydrolysates, Enzymatic Saccharification, and Ethanol Fermentation." Journal of Biomedicine and Biotechnology. vol. 2012, Article ID 989572, 15 Pages.
Hamisan, et al. "Delignification of Oil Palm Empty Fruit Bunch Using Chemical and Microbial Pretreatment Methods." International Journal of Agricultural Research, 4: 250-256, 2009.
Sun, et al. "Hydrolysis of lignocellulosic materials for ethanol production: a review." Bioresource Technology 83 (2002) 1-11.
Galbe, et al. "A review of the production of ethanol from softwood." Appl Microbiol Biotechnol (2002) 59:618-628.
Eriksson, et al. "Biotechnology in the pulp and paper industry." Wood Sci. Technol. 24:79-101 (1990).
Knauf, et al. "Lignolcellulosic biomass processing: a perspective." International Sugar Journal. vol. 106, No. 1263, pp. 147-150 (2004). Abstract. CAB Direct.
Rosgaard, et al. "Comparison of different Pretreatment Strategies for Enzymatic Hydrolysis of Wheat and Barley Straw." Appl Biochem Biotechnol (2007), 143:284-296.
Demirbas. "Progress and recent trends in biodiesel fuels." Energy Conversion and Magenement 50 (2009) 14-34.
Prasad, et al. "Ethanol as an alternative fuel from agricultural, industrial and urban residues." Resources, Conservation and Recyclnig 50 (2007) 1-39.
Fernandes Pereira, et al. "Sugarcane bagasse pulping and bleaching: Thermal and chemical characterization." BioResources 6(3), 2471-2482.
Taherzadeh, et al. "Acid-based hydrolysis processes for ethanol from lignocellulosic materials: a review." BioResources 2(3), 472-499, 2007.
Scheper, et al. "Biofuels." Advances in Biochemical Engineering/Biotechnology, 108, Aug. 8, 2007.
Duff, et al. "Bioconversion of the Forest Products Industry Waste CEelulosics to Fuel Ethanol: A review." Bioresearch Technology, vol. 55(1), 1-33, 1996.

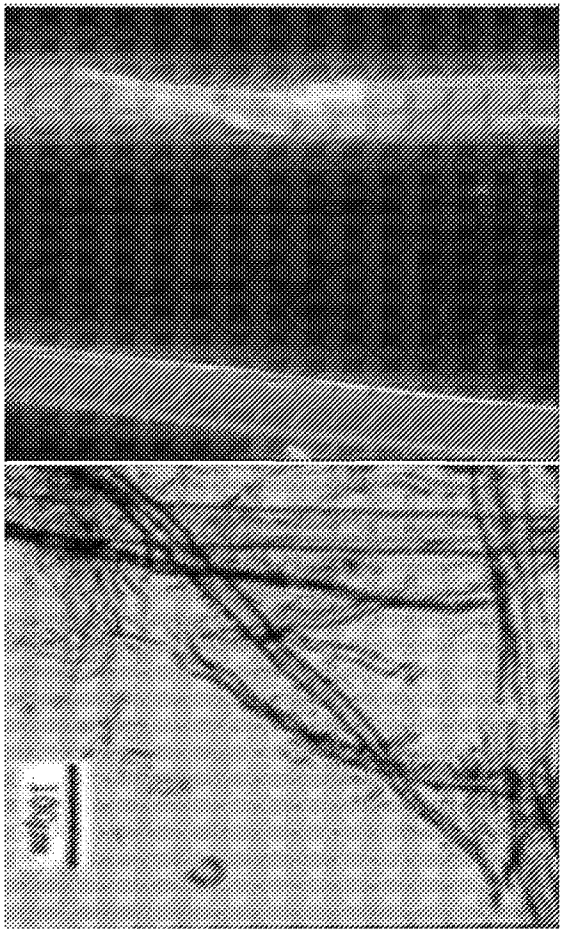
(a) (b)

METHOD TO PRODUCE HIGH-RESISTANCE CELLULOSE AND HEMICELLULOSE FIBERS FROM LIGNOCELLULOSIC BIOMASS OF SUGARCANE LEAVES AND BUDS

RELATED APPLICATIONS

This application is the United States National Stage of International Application No. PCT/IB2012/053393 filed Jul. 4, 2012, which was published as International Publication No. WO 2013/008135 Al, and which claims benefit of Colombian Patent Application No. 201186711 filed Jul. 12, 2011. Both applications are incorporated by reference in their entirety herewith.

FIELD OF INVENTION

This invention is related to a novel method to obtain high-resistance cellulose and hemicellulose from lignocellulosic biomass coming from sugarcane leaves and buds and with a fibrous pulp material that presents high contents in high-resistance cellulose and hemicellulose obtained from sugarcane leaves and buds, suitable for the paper production and other chemical products and polymeric-type plastics.

BACKGROUND OF THE INVENTION

The constant decrease and loss of the forest cover and environmental contamination has triggered the development of technologies that impede deforestation, which is why—currently—different processes have been developed for the treatment of agricultural wastes from the sugarcane harvest. At industrial level, we find that processes of transformation of the plant material to obtain paper historically represent the longest experience in managing lignocellulosic materials, which is why the paper industry has been in charge of setting the pace in the design of processes to extract and separate cellulose from the complex formed with lignin and hemicellulose. This industry has been using an important quantity of chemical and enzymatic processes to treat the material, which in some cases are responsible for generating organo-chlorine compounds that negatively affect the environment (Eriksson K. E. 1990. Biotechnolgy in the pulp and paper industry. Wood Sci. Technol., 24: 79-101).

Traditionally, paper is produced by pulping a material that contains cellulosic fibers, interweaving the cellulosic fibers to form a humid network, and drying of the humid network. Pulping can be carried out through different methodologies, while the most common source of cellulosic fiber used in the processes is wood pulp from trees, other fibrous plant materials are also used like cotton, hemp plant, flax, rice, sugarcane, bagasse, straw, and bamboo, among others. Particularly, sugarcane bagasse is composed of three polymeric-type essential ingredients: cellulose at 40 to 45%, hemi-cellulose (xylan) at 28 to 30%, and lignin at 19 to 21%, in addition to other substances and to the cell mass.

The use of wastes from the sugarcane harvest result especially interesting for the pulping industry, given that sugarcane presents high contents of cellulosic-type fibrous materials like cellulose, hemicellulose, and lignin used for paper production and in a broad variety of industrial and consumer products.

In the state of the technique, it is acknowledged that fractioning of polymeric components from plant biomass represents an obstacle for the industry, which is why research related to delignifying different lignocellulosic materials has been of interest over the last two decades (Hendrinks A. T. W. M. and Zeeman G., 2009. Pretreatments to enhance the digestibility of lignocellulosic biomass. Bioresource technology. 100:10-18; Demirbas A., 2007. Progress and recent trends in biofuels. Progress in energy and combustion science. 33:1-18; Knauf M., Moniruzzaman M., 2004. Lignocellulosic biomass processing: A perspective. International sugar journal. 106:147-150) to the point that different stages have been created within the processes known for the treatment of plant material and, in other cases, novel processes have been designed by applying advanced technologies to obtain cellulosic and hemicellulosic fibers as raw material for the paper industry. Regarding pretreatments, chemical processes, biological processes, and to a lesser degree enzymatic processes have been studied, as well as pretreatment with ionizing radiation.

Some of the investigations related to treatment of sugarcane bagasse and leaves subjected to different pretreatments were published by Gonçalves et al., (Gonçalves A. R., Benar P., Costa S. M., Ruzene D. S., Moriya R. Y., Luz S. M., Ferreti P., 2005. Integrated processes for use of pulps and lignins obtained from sugarcane bagasse and straw. Applied Biochemistry and Biotechnology. Vol 121-124: 821-826). In their investigation different alternatives were suggested for use of wastes and they reported on the composition of sugarcane bagasse, indicating that it contains 43.7% cellulose, 24.4% hemicellulose, 28% lignin, and 0.75% ash. However, their studies do not contribute to the state-of-the-art on the composition of sugarcane leaves as starting material for pulp production or as precursor to obtain paper.

Also, García and Larrahondo studied the chemical hydrolysis of wastes from the sugarcane harvest, particularly, leaves and buds through using sulfuric acid diluted in concentrations ranging between 5, 10, 15, 20, and 30% v/v, conserving the temperature range between 97 and 107° C., for an approximate reaction time of 6.5 hours. The study analyzed the liberation of glucose during each hour and all the findings reported bear in mind the prior separation of the sugarcane leaves and buds.

Traditionally, sugarcane leaves and buds are burnt before the start of the harvest, and in those cases in which green cut is carried out, the plant material is abandoned on the field to allow for its decomposing.

According to data reported (Torres J. S. y Villegas F., 2006. Manejo y aprovechamiento de residuos de la cosecha en verde. Serie técnica No 35 (Cenicaña). Marzo de 2006), it is estimated that after the sugarcane green harvest 50 to 70 t/ha of green biomass are produced and if it is considered that in 15-month cycles the contribution of wastes in cultivated areas is mainly constituted by the buds and portions adhered to the stalk like green and dry leaves, making it necessary to develop a process that permits its utilization and, thus, contribute to decrease environmental contamination. This contribution of biomass becomes an important reserve of organic matter for the system of sustainable production from the sugarcane crop, while promoting the recycling of the plant material for other derived industries like paper production.

It is known that fiber from buds and from leaves differs morphologically; the latter constitute 20% of the plant and may be considered long fibers, considering them a suitable material to substitute soft wood fibers.

The energy supply from sugar mills from sugarcane bagasse brings to another scenario where it is imperative and necessary to develop other alternative sources of fiber that permit a stable supply to the industry and substitution of imports. Leaves and buds emerge as an alternative source of promising fiber in our country for the cellulose and paper industry in years to come.

Using bagasse from sugarcane and eucalyptus for paper production is still in doubt, although it is currently constituted as the main fibrous source for the cellulose industry and for production of paper and agglomerates in Colombia, the requirements of the digestion process of sugarcane bagasse and subsequent fractioning of the fibers for paper production and the improper exploitation of lumber have placed at environmental risk the zones where both the treatment and exploitation take place, which is why obtaining pastes from lignocellulosic wastes provided by wastes from sugarcane green harvest like leaves and buds, offers the possibility of creating technological alternatives based on the treatment of substitute materials and products derived from sugarcane cultivation with higher added value, lower consumption of energy required for transformation, along with the possibility to obtain paper and raw material more economically.

Also, with respect to patent publications related to the use of lignocellulosic material to manufacture paper, there is document WO 2010060183, which discloses a modular process of bio-refinement to separate and process lignocellulosic material comprising the classification and fractioning of lignocellulosic material by reaction with aliphatic alcohol or with acetone, to obtain a solid cellulosic fraction (VHMW). Delignifying of the VHMW fraction is conducted in the presence of $ClO_2$ at concentrations ranging between 3 and 4% and a temperature between 60 and 80° C., followed by washing with water and then, washing with diluted alkaline solution at a temperature between 45 and 90° C. The fractions obtained contain derivatives of high and medium molecular weight lignin (HMW-MMW) and very low molecular weight lignin (VLMW). Finally, in an anaerobic digestion module the semi-solid waste is processed with a biogas and a liquid effluent.

Likewise, patent EP0716182 discloses a method for delignifying and bleaching pulp comprising the formation of a pulp by pulping with organic solvents (Kappa number between 20 and 70), from fibrous plant material, washed with a solution that contains aliphatic alcohol at a concentration of 20 to 80% v/v and then, washed with water. Thereafter, the pulp is bleached by treating with peroxide at a concentration of 0.2 to 2% w/w, washed and delignified by treating with sodium hydroxide (NaOH) at a concentration of 2 to 8% w/w and pressure between 30 and 100 psig. Thereafter, bleaching is carried out with peroxide in the presence of a chelating transition metal added at a concentration between 0.05 to 1% and finally, washing of the pulp is done with sulfurous acid at pH 2-3. Optionally, ozone treatment is included.

U.S. Pat. No. 4,956,048 refers to a method to improve the pulping and chemical bleaching that includes repeated washing of the pulp with water and pretreatment of the material with a hydro-alcoholic mixture and de-ionized water, to continue with the bleaching stage; thus, accomplishing the reduction of the formation of chlorinated dioxins and furans.

Likewise, U.S. Pat. No. 5,531,865 discloses a process to prepare cellulose for human consumption comprising the reduction of the plant material's particle size (20 mesh), removal of lipid compounds, dissolution in water, and cooking with gaseous Cl to obtain a pulp that is re-dispersed in water and oxidized in the presence of chlorine. Then, the free Cl is removed and NaOH is added to digest the cellulosic material present; the pulp is separated and the oxidation stage is repeated.

It is notable that in recent years, great interest has been generated in the search for new alternatives for processes of obtaining cellulosic pulp, seeking to improve those already existing and trying to create new methods.

Practically all the laboratories of the big cellulose and paper manufacturers are dedicated to evaluating their production processes attempting to not only modify, but substitute the conventional production systems and the process developed constitutes a technological alternative for the industry because it reduces production costs based on detailed knowledge of the kinetics of the delignifying process, which also provides information on the probable energy consumption of this chemical reaction stage.

The invention process is mainly characterized by presenting a first stage of cooking the lignocellulosic material to dissolve the lignin and other non-cellulosic portions of the material that permits forming a pulp of individual fibers that can again be joined, forming a paper sheet.

The advantages associated to one of the modalities of the invention basically consist of using ethanol to obtain pulp and combine it with alkaline processes, increasing the selectivity of delignifying and leaving the hemicellulose almost intact because of the addition of alcohols and amines during the production of alkaline pulps.

In this order, a method needs to be designed to process plant material from sugarcane harvest wastes that will overcome the disadvantages associated to temperature and to pulping time and which will permit controlling the advance of delignifying through indicators like the H factor. All this, bearing in mind that no industrial process exists that functions solely on a two-stage alcohol-water process and subsequent soft delignifying with ethanol chlorine dioxide and which also uses a mixture of sodium hydroxide and potassium hydroxide as catalyst and which overcomes the disadvantages of the methods traditionally used, where there are higher costs in required infrastructure because these require recovery boilers and longer cooking times, as well as higher temperature and concentration of solvents.

BRIEF DESCRIPTION OF THE FIGURES

FIG. 1 presents a comparison via optical microscopy with 100× magnification between a fiber obtained from sugarcane leaves and buds through the invention process (a) and a long fiber of radiata pine (b).

OBJECTS OF THE INVENTION

In a first aspect, the invention is related to a process to delignify sugarcane leaves and buds that permit producing high-resistance, long cellulose and hemicellulose fibers.

In a second aspect, la invention provides a fibrous pulp material with high contents of high-resistance cellulose and hemicellulose obtained from sugarcane leaves and buds, suitable for paper production and other chemical products and polymeric-type plastics.

DETAILED DESCRIPTION OF THE INVENTION

The present invention reveals a method for the production of high-resistance cellulose and hemicellulose fibers from lignocellulosic biomass, obtained from sugarcane leaves and buds comprising the following stages:

1. a) Diminish the particle size of the lignocellulosic biomass to a range between 3 and 15 mm,
1. b) Subject the product obtained to a treatment with one or more solvents and/or a mixture of specific catalysts, at a temperature between 383-403 K with a liquor:dry fiber ratio between 1.9-8.5:1 during a time from 5 to 125 min, 1. c) Carry out sudden decompression to atmospheric pressure in a reactor.
1. d) Collect the pre-treated material in a cyclone,
1. e) Separate the liquid and solid fractions by washing and filtering,
1. f) Optionally, treat the solid fraction in a reactor with a mixture of ethanol 40 to 60% w/w referred to the dry fiber and chlorine dioxide 1-5% v/v at a temperature between 343 and 373 Kat pressure of 20 to 40 psig for a time between 10 and 30 minutes.
1. g) Wash the product to achieve an efficiency of cellulose above 50% and of lignin of 5 to 7%, fiber length in the range of 1.5 to 2.7 mm, breaking length (km) of 7.0-8.9, Burst index ($kPam^2/g$) of 4.5-7.2, and Tear index ($mNm^2/g$) of 8.2-8.9.

To develop the first stage of the invention method, it is necessary to reduce the size of the lignocellulosic biomass particles before subjecting the plant material from sugarcane leaves and buds to pretreatment. For this initial mechanical treatment, based on cutting the lignocellulosic material (sugarcane leaves and buds) a blade mil was used, sieving, and taking the sample pore size (30 and 40 mesh). The finer sizes are discarded and are not used because they have higher energy consumption and chemical solvents and because they degrade rapidly in 5 to 6 carbon sugars and then to furfurals.

In stage (b) of the process the lignocellulosic material is subjected to a cooking treatment with one or more solvents and/or a mixture of specific catalysts in a digester, at a temperature between 383-403 K with a liquor-material ratio between 1.9-8.5:1 during 5 to 125 min until reaching a degree of cooking with an H factor equivalent to 18 Kappa.

The aforementioned, bearing in mind that the H factor is the integral in the time of the relative rate of delignifying, or best time in hours necessary to dissolve a lignin mass, a conventionally accepted parameter to define the delignifying kinetics in processes to obtain cellulose.

Within the reach of the invention, this stage can be developed by employing different methods, which include:

1A mixture of an aqueous organic solvent, preferably ethanol, which incorporates NaOH in the range of 2 to 3% p/p referred to dry fiber, KOH in the range of 0.1 at 1% w/w referred to dry fiber, and sodium sulfate 0.5-1.5% w/w referred to dry fiber as catalyst with a liquor-material ratio between 7 and 8.5:1.

1. 2. A mixture based on caustic soda in the range between 5 and 10% and anthraquinone at an approximate ratio between 40 an 70 g per liter of solution or expressed in terms of proportion: 4 to 1 of pulp:soda and 2 g/l of anthraquinone or 0.2 to 0.35 kg of anthraquinone per ton of pulp, until obtaining an alkali of 70 in the white liquor or 70% activation, with a liquor-material ratio between 1.9 and 2.5:1. This treatment is conducted at pressure between 79 and 101 psig.
1. 3. A mixture based on caustic soda in the range between 40 and 70 g/l of solution and $Na_2S$ at a concentration of 0.5 to 5 g/l per ton of pulp, with a liquor:material ratio between 1.9 and 3.7:1. This treatment is conducted at pressure between 83 and 105 psig.

During the heat treatment with the solvent and catalysts formation of a delignified wet lignocellulosic mass is produced. With the adequate temperature we manage to force the solubilizing of lignin, protecting the cellulose fibers and a part of the hemicellulose fibers, creating a medium that overcomes the lignin adhesion energy barriers, self-hydrolysis, and the solubilizing that breaks the bond of the lignin polymer from the hemicellulose and cellulose fibers. While the water vapor and the solvent are introduced within the lignocellulose fiber structure, because the diffusion of the vapor phase is of greater magnitude than the diffusion of the liquid phase; thereby, penetration is produced first and then expansion.

Once the cooking phase has terminated in stage (b) a sudden decompression is carried out in a continuous reactor or Bach reactor or by stages to atmospheric pressure permitting the gases within the reactor to produce a rupture of the crystallinity of cellulose. Upon depressurizing the reactor, sudden evaporation of the capillary water-solvent is produced, which exerts the mechanical effect of disaggregating and breaking some fibers of the material subjected to treatment. Upon ending the treatment stage, collect the treated material in a cyclone (stage d), filter by separating the liquid fraction from the solid, and carry out the stage of washing and filtering the material.

Optionally, the washed and filtered solid fraction may be treated in a reactor with a mixture of ethanol 40 to 60% w/w referred to dry fiber and chlorine dioxide 1-5% v/v at a temperature between 343 and 373 Kat pressure of 20 to 40 psig for a time between 10 and 30 minutes.

As a final stage, fibers are washed to achieve cellulose efficiency above 50% and of lignin of 5 to 7%, fiber length in the range of 1.5 to 2.7 mm, breaking length (km) of 7.0-8.9, Burst index ($kPam^2/g$) of 4.5-7.2, and Tear index ($mNm^2/g$) of 8.2-8.9.

DESCRIPTION OF THE PREFERRED MODALITIES OF THE INVENTION

During a first object of the process disclosed through the present invention, a method is revealed for the production of high-resistance cellulose and hemicellulose fibers from lignocellulosic biomass, obtained from sugarcane leaves and buds, comprising the following stages:

1. a) Diminish the particle size of the lignocellulosic biomass to a range between 3 and 15 mm,
1. b) Subject the product obtained to a treatment with a mixture of an aqueous organic solvent, preferably ethanol, which incorporates NaOH within the range of 2 to 3% w/w referred to dry fiber, KOH in the range of 0.1 to 1% w/w referred to dry fiber, and sodium sulfate 0.5-1.5% w/w referred to dry fiber as catalyst, at a temperature between 383-403 K with a liquor:dry fiber ratio between 7-8.5:1 during a time of 5 to 125 min, preferably between 5 and 40 min.
1. c) Carry out sudden decompression to atmospheric pressure in a reactor.
1. d) Collect the pre-treated material in a cyclone.
1. e) Separate the liquid and solid fractions by washing and filtering.

1. f) Treat the solid fraction in a reactor with a mixture of ethanol 40 to 60% w/w referred to the dry fiber and chlorine dioxide 1-5% v/v at a temperature between 343 and 373 K at pressure of 20 to 40 psig for a time between 15 and 25 minutes.

1. g) Wash the product to reach cellulose efficiency above 90% and of lignin from 5 to 7%, average fiber length of 2.7 mm; breaking length (km) of 7.0-8.9, preferably between 7.8 and 8.9; Burst index ($kPam^2/g$) of 4.5-7.2, preferably between 6.8 and 7.2; Tear index ($mNm^2/g$) of 8.2-8.9, preferably between 8.5 and 8.9.

A second object of the process of the present invention discloses a method to produce high-resistance cellulose and hemicellulose fibers from lignocellulosic biomass, obtained from sugarcane leaves and buds comprising the following stages:

1. a) Diminish the particle size of the lignocellulosic biomass to a range between 3 and 15 mm,
1. b) Subject the product obtained to treatment with a mixture based on caustic soda in the range between 5 and 10% and anthraquinone at an approximate ratio between 40 and 70 g per liter of solution or expressed in terms of proportion: 4 to 1 of pulp:soda and 2 g/l of anthraquinone or 0.2 to 0.35 kg of anthraquinone per ton of pulp, until obtaining an alkali of 70 in the white liquor or a 70% activation, with a liquor-material ratio between 1.9 and 2.5:1. This treatment is conducted at pressure between 79 and 101 psig, temperature between 383-403 K, and a liquor:dry fiber ratio between 7-8.5:1 during a time of 12 to 125 min, preferably between 10 and 40 min,
1. c) Carry out sudden decompression to atmospheric pressure in a reactor.
1. d) Collect the pre-treated material in a cyclone,
1. e) Separate the liquid and solid fractions by washing and filtering,
1. f) Wash the product to reach cellulose efficiency above 50% and of lignin of 5 to 7%, fiber length in the range of 1.5 to 2.7 mm, preferably between 1.5 and 1.9; breaking length (km) of 7.0-8.9, preferably between 7.0 and 7.5; Burst index (kPam$^2$/g) of 4.5-7.2, preferably between 4.5 and 4.9; Tear index (mNm$^2$/g) of 8.2-8.9, preferably between 8.3 and 8.7.

A third object of the process of the present invention discloses a method to produce high-resistance cellulose and hemicellulose fibers from lignocellulosic biomass, obtained from sugarcane leaves and buds comprising the following stages:

1. a) Diminish the particle size of the lignocellulosic biomass to a range between 3 and 15 mm,
1. b) Subject the product obtained to treatment with a mixture based on caustic soda in the range between 40 and 70 g/l of solution and Na2S at a concentration of 0.5 to 5 g/l per ton of pulp, with a liquor:material ratio between 1.9-3.7:1. This treatment is conducted at pressure between 83 and 105 psig, temperature between 383-403 K during a time of 12 to 125 min, preferably between 90 and 125 min.
1. c) Carry out sudden decompression to atmospheric pressure in a reactor.
1. d) Collect the pre-treated material in a cyclone,
1. e) Separate the liquid and solid fractions by washing and filtering,
1. f) Wash the product to reach cellulose efficiency above 50% and of lignin of 5 to 7%, fiber length in the range of 1.5 to 2.7 mm, preferably between 0.9 and 1.2; breaking length (km) of 7.0-8.9, preferably between 8.0 and 8.8; Burst index (kPam2/g) of 4.5-7.2, preferably 5.5 to 6.5; Tear index (mNm2/g) of 8.2-8.9, preferably 8.3 to 8.7.

In chemical pulping, delignifying is carried out to the point of liberating the fiber where its separation is achieved with very little mechanical energy. The delignifying reaction is produced in the heterogeneous phase; this is because lignin is present cellulosic raw material in solid phase and reacts with the dissolved alkali in the liquid phase to achieve its fragmentation and its passage to the liquid phase. The delignified cellulosic raw material permits obtaining a cellulosic paste, while in the liquid phase there are only those components of the cellulosic raw material that have been dissolved like lignin, which permits obtaining black liquor gel. In this method, the rate of delignifying varies sensibly with temperature.

In a second aspect, the invention provides a fibrous pulp material that presents high contents of high-resistance cellulose and hemicellulose obtained from sugarcane leaves and buds, suitable for paper production and other chemical products and polymeric-type plastics. This fibrous pulp material obtained through the method previously described presents cellulose contents above 50% and of lignin of 5 to 7%, fiber length in the range of 1.5 to 2.7 mm, breaking length (km) of 7.0-8.9, Burst index (kPam2/g) of 4.5-7.2, and Tear index (mNm2/g) of 8.2-8.9.

The following examples are presented to describe the preferred aspects of the invention, which do not constitute limits to the invention unless strictly established in the claims.

EXAMPLES

1. Obtaining Cellulose and Hemicellulose Fibers from Sugarcane Leaves and Buds by Trying the Material with a Mixture of Aqueous Organic Solvent.

Before subjecting the leaves and buds to pretreatment, reduce the particle size to a range between 3 and 15 mm; for this mechanical cut of the lignocellulosic material (sugarcane leaves and buds), use a blade mill, sieve, and take the pore size sample at 30 and 40 mesh; the finest are discarded, they are not used because they consume energy, chemicals, and are rapidly degraded to 5 and 6 carbon sugars and furfurals.

The plant material is subjected to a cooking process in a 10-liter capacity discontinuous laboratory digester by using 500 g (b.$) of sample with heating by resistance to a high-temperature oil, which transfers the heat to the vessel containing the sample. The cooking hydro-module is of 7-8.5:1 (ratio of kg of dry fiber:kg of cooking liquor), with 55-57% weight of solvent 99.7 G.L. (Gay Lusac degrees), referred to the dry fiber and 2.3-2.5 wt % NaOH, 0.3-0.5 wt % KOH, and sodium sulfate 0.7-1.1 wt % as catalyst (referred to the dry fiber). A degree of cooking should be reached with an H factor equivalent to 18 Kappa during a time between 12 and 18 minutes of cooking at the indicated temperature.

During the heat treatment with alcohol and vapor, formation of a delignified wet lignocellulosic mass is produced. Given that the temperature is sufficiently high to thermodynamically force the dissociation of water and the solubilisation of lignin, with hemicellulose precipitation, a medium is created that overcomes the energy barriers of hydrolysis and self-hydrolysis and solubilisation are produced, which break the lignin polymer and the hemicellulose bond. Meanwhile, and because the diffusion of the vapor phase is of greater magnitude than the diffusion of the liquid phase, the water vapor and alcohol are introduced within the lignocellulose fiber structure. First, penetration is produced and then its subsequent expansion and rupture.

Upon depressurizing the material, sudden evaporation is produced of the capillary water-ethanol, which has the mechanical effect of disaggregating and breaking some fibers. Once the pre-treatment stage is ended, collect the material and filter by separating the liquid fraction from the solid. This material is washed and again integrated onto the reactor at a second soft cooking with pH of 10.5 with 11.5% consistency, ethanol ratio at 55 wt % ethanol 99.7 G.L. (Gay Lusac degrees), referred to dry fiber and chlorine dioxide at 3% (v/v), during 15 min, at 83° C. and pressure between 20 and 40 psig, then depressurized again, which permits the gases within the reactor to suddenly expand. Finally, the pulp is washed for subsequent characterization and efficiency study.

Among the technical characteristics analyzed of the cellulose and hemicellulose fibers obtained by the pulping process of the invention, we have:

Breaking length: Measures the amount of paper in kilometers necessary to break a paper strip by its own weight.

Burst resistance (Mullen): Resistance offered by the paper to rupture by pressure on one of its faces.

Tearing resistance: Resistance offered by the paper to continued tearing.

The pulp obtained through the method of producing high-resistance cellulose and hemicellulose fibers from lignocellulosic biomass from sugarcane leaves and buds show good physical-chemical properties, comparable to those obtained with more traditional trees and with sugarcane bagasse.

The results presented in Table 1 show that the material obtained from the lignocellulosic biomass from sugarcane leaves and buds is suitable for the production of high-resistance pulp destined to the manufacture of writing paper, as shown in the comparative study which analyzed the technical characteristics of other cellulose and hemicellulose fibers obtained from biomass of eucalyptus, pine, and sugarcane bagasse against fibro-cellulosic pulp obtained from sugarcane leaves and buds.

According to FIG. 1, when observing the type of fiber obtained by the invention process (FIG. 1*a*) through optical microscopy (magnification 100×), it is possible to find fibers of average length equivalent to 2.7 mm, with average diameter of 0.5 to 0.6 mm, data surpassing current averages of fibers used in the manufacture of white paper (FIG. 1*b* and Table 1). It is worth mentioning that runs were made in triplicate, as well as the microscopic measurement to ensure replication of the results obtained through the invention method.

Table 1. Comparative quality parameters of fibers obtained from sugarcane leaves and buds against fibers from other sources

TABLE 1

| Species | Average length (mm) | Breaking length (km) | Burst index (kPa m2/g) | Tear index (mNm2/g) |
|---|---|---|---|---|
| *Eucalyptus* | 0.9-1.2 | 8.8 | 6 | 8.5 |
| Pine | 3.1-3.7 | 10.2 | 7.2 | 9 |
| Bagasse | 1.5-1.7 | 7.1 | 4.7 | 8.2 |
| Leaves and Buds | 1.9-2.3 | 7.9 | 5.9 | 8.7 |

As shown by the findings revealed by the microscopy tests what is accomplished with the process of delignifying sugarcane leaves and buds in two stages, through treatment with alcohol, hydroxides, sodium sulfate, and chlorine dioxide with rapid depressurization is an enriched fiber.

Additionally, the method permits protecting hemicellulose and rapid separation of cellulose fibers still bonded to each other through the effect of the rapid decompression that ends up breaking the lignocellulosic bonds that keep the fibers together; thus, producing fibers with exceptional quality. The result is a material rich in hemicellulose and cellulose and fibers suitable for production of high-quality paper.

To know the final state of the fibers during the last stage of the method, the percentage of delignifying was measured through the Kappa number and as indicator of the amount of carbohydrates deteriorated the kinematic viscosity coefficient was measured, which is used as a direct method to quantify the percentage of cellulose and hemicellulose degradation, as well as the paper's resistance properties according to Canadian Standard Freeness.

2. Obtaining Cellulose and Hemicellulose Fibers from Sugarcane Leaves and Buds by Treating the Material with a Mixture Based on Caustic Soda and Anthraquinone.

Sugarcane wastes (leaves and los buds) are subjected to mechanical treatment by milling the lignocellulosic biomass until obtaining a particle size between 3 and 15 mm. Then, the product obtained is subjected to treatment under softer cooking conditions than the traditional process, diminishing the temperature of the reactors to values between 403 and 428 K and keeping pressure around 79-101 psig with a liquor prepared based on caustic soda, with an approximate concentration at 7% and anthraquinone at an approximate ratio of 40 to 70 g per liter of solution with a liquor-material ratio between 1.9 and 2.5:1. This result is achieved by applying a cooking time between 17 and 25 min. Thereafter, sudden decompression is carried out to atmospheric pressure, the treated material is collected in a cyclone, from where it is sent to the washing section; there, the liquid and solid fractions are separated via the washing and filtering process. With this process, we obtain 55% cellulose efficiency, 5-7% residual lignin, average fiber length of 1.5-1.9 mm, breaking length (km) of 7.0-7.5, Burst index (kPam2/g) of 4.5 to 4.9, and Tear index (mNm2/g) of 8.2 to 8.4.

The pulp obtained by the procedure described is light beige without remnant chips. The soda-anthraquinone pulping was effective for cooking the lignocellulosic material from leaves and buds of the sugarcane varieties harvested in Colombia and for the production of pulp, being quite selective in eliminating lignin without deteriorating the cellulose, a result reflected in an efficiency that does not surpass that of the method of the invention and which has as disadvantage the time required for treatment.

3. Obtaining Cellulose and Hemicellulose Fibers from Sugarcane Leaves and Buds by Treating the Material with a Mixture Based on Caustic Soda and $Na_2S$.

Wastes from sugarcane harvest (leaves and los buds) are subjected to mechanical treatment by milling the lignocellulosic biomass until obtaining a size between 3 and 15 mm. Thereafter, the product obtained is subjected to treatment under traditional cooking conditions, at temperatures between 418-438 K and maintaining pressure around 83 to 105 psig with liquor prepared based on caustic soda, with an approximate concentration of 105-125 g/l and a concentration of 17 to 25 g/l of $Na_2S$, with a liquor-material ratio between 1.9 and 3.7:1. This result is achieved by applying a cooking time between 90 and 125 min. Then, sudden decompression is carried out in a continuous reactor or by stages to atmospheric pressure, the treated material is collected in a cyclone, from where it is sent to the washing section; there, the liquid and solid fractions are separated by the washing and filtering process. With this process, it is possible to obtain cellulose efficiency of 50%, 5-7% of residual lignin, average fiber length of 0.9-1.2 mm, breaking length (km) 8.0-8.8, Burst index (kPam2/g) of 5.5 to 6.5, and Tear index (mNm2/g) of 8.3 to 8.7).

The invention claimed is:

1. A method for the production of cellulose and hemicellulose fibers from lignocellulosic biomass by applying a differential process comprising the stages of:

a) Diminishing the particle size of the lignocellulosic biomass to a range between 3 and 15 mm, and wherein the lignocellulosic biomass is obtained from sugarcane leaves and buds, b) Treating the diminished particle size biomass with one or more solvents and a mixture of specific catalysts, at a temperature between 383- 403 K with a liquor: dry fiber ratio by weight between 1.9- 8.5:1 during a time of 5 to 125 min, c) Subjecting the diminished particle size biomass to sudden decompression to atmospheric pressure in a reactor, d) Collecting the material in a cyclone, e) Separating the liquid and solid fractions through washing and filtering, f) Optionally, treating the solid fraction in a reactor with a mixture of ethanol 40 to 60% w/w referred to the dry fiber and chlorine dioxide 1-5% v/v, g) Washing the solid fraction to achieve cellulose efficiency above 50% and of lignin of 5 to 7%, fiber length in the range of 1.5 to 2.7 mm, breaking length (km) of 7.0- 8.9, Burst index (kPam2/g) of 4.5-7.2, and Tear index (mNm2/g) of 8.2-8.9.

2. The method of claim 1, further characterized in that in stage (b) the diminished particle size biomass is subjected to treatment with a mixture of an aqueous organic solvent, which incorporates NaOH in the range of 2 to 3% w/w, KOH in the range of 0.1 to 1% w/w, and sodium sulfate 0.5-1.5% w/w at a temperature between 383-403 K with a liquor : dry fiber ratio by weight between 7-8.5:1 during a time of 5 to 125 min.

3. The method of claim 1, further characterized in that in stage (f) the solid fraction obtained in stage (d) is treated with a mixture of ethanol 40 to 60% w/w and chlorine dioxide 1-5% v/v at a temperature between 343 and 373 K, at pressure of 20 to 40 psig for a time between 10 and 30 minutes.

4. The method of claim 1, further characterized in that the washed solid fraction achieves an average fiber length of 2.7 mm, breaking length (km) between 7.8 and 8.9, Burst index (kPam2/g) between 6.8 and 7.2, and Tear index (mNm2/g) between 8.5 and 8.9.

5. The method of claim 1, further characterized in that in stage (b) the diminished particle size biomass is subjected to treatment with a mixture based on caustic soda in the range between 5 and 10% and anthraquinone in the range of 40 to 70 g per liter of solution until obtaining an alkali of 70 in the white liquor and 70% activation, with a liquor dry fiber ratio by weight between 1.9 and 2.5:1 at pressure between 79 and 101 psig, temperature between 383-403 K during a time of 5 to 125 min.

6. The method of claim 1, further characterized in that the washed solid fraction achieves a fiber length between 1.5 and 1.9 mm; breaking length (km) between 7.0 and 7.5; Burst index (kPam2/g) between 4.5 and 4.9; Tear index (mNm2/g) between 8.3 and 8.7.

7. The method of claim 1, further characterized in that in stage (b) the diminished particle size biomass is subjected to treatment with a mixture based on caustic soda in the range between 40 and 70 g/l of solution and Na2S at a concentration of 0.5 to 5 g/l per ton of pulp, with a liquor : dry fiber ratio by weight between 1.9-3.7:1, at pressure between 83 and 105 psig, temperature between 383-403 K during a time of 12 and 125 min.

8. A method for the production of cellulose and hemicellulose fibers from lignocellulosic biomass by applying a differential process comprising the stages of:

a) Diminishing the particle size of the lignocellulosic biomass to a range between 3 and 15 mm, and wherein the lignocellulosic biomass is obtained from sugarcane leaves and buds, b) Treating the diminished particle size biomass with one or more solvents and a mixture of specific catalysts, at a temperature between 383-403 K with a liquor: dry fiber ratio by weight between 1.9-8.5:1 during a time of 5 to 125 min, c) Subjecting the diminished particle size biomass to sudden decompression to atmospheric pressure in a reactor, d) Collecting the material in a cyclone, e) Separating the liquid and solid fractions through washing and filtering, f) Optionally, treating the solid fraction in a reactor with a mixture of ethanol 40 to 60% w/w referred to the dry fiber and chlorine dioxide 1-5% v/v, g) Washing the solid fraction to achieve cellulose efficiency above 50% and of lignin of 5 to 7%, and fiber length between 0.9 and 1.2 mm; breaking length (km) between 8.0 and 8.8;

Burst index (kPam2/g) between 5.5 and 6.5; Tear index (mNm2/g) between 8.3 and 8.7.

9. A method for the production of cellulose and hemicellulose fibers from lignocellulosic biomass by applying a differential process comprising the stages of:

a) Diminishing the particle size of the lignocellulosic biomass to a range between 3 and 15 mm, and wherein the lignocellulosic biomass is obtained from sugarcane leaves and buds, b) Treating the diminished particle size biomass with one or more solvents and a mixture of specific catalysts, at a temperature between 383-403 K with a liquor: dry fiber ratio by weight between 1.9-8.5:1 during a time of 5 to 125 min, c) Subjecting the diminished particle size biomass to sudden decompression to atmospheric pressure in a reactor, d) Collecting the material in a cyclone, e) Optionally, treating the solid fraction in a reactor with a mixture of ethanol 40 to 60% w/w referred to the dry fiber and chlorine dioxide 1-5% v/v, f) Washing the solid fraction to achieve cellulose efficiency above 50% and of lignin of 5 to 7%, fiber length in the range of 1.5 to 2.7 mm, breaking length (km) of 7.0-8.9, Burst index (kPam2/g) of 4.5-7.2, and Tear index (mNm2/g) of 8.2-8.9.

10. The method of claim 9, further characterized in that in stage (b) the diminished particle size biomass is subjected to treatment with a mixture of an aqueous organic solvent, which incorporates NaOH in the range of 2 to 3% w/w, KOH in the range of 0.1 to 1% w/w, and sodium sulfate 0.5-1.5% w/w at a temperature between 383 -403 K with a liquor : dry fiber ratio by weight between 7-8.5:1 during a time of 5 to 125 min.

11. The method of claim 9, further characterized in that in stage (e) the solid fraction obtained in stage (d) is treated with a mixture of ethanol 40 to 60% w/w and chlorine dioxide 1-5% v/v at a temperature between 343 and 373 K, at pressure of 20 to 40 psig for a time between 10 and 30 minutes.

12. The method of claim 9, further characterized in that the washed solid fraction achieves an average fiber length of 2.7 mm, breaking length (km) between 7.8 and 8.9, Burst index (kPam2/g) between 6.8 and 7.2, and Tear index (mNm2/g) between 8.5 and 8.9.

13. The method of claim 9, further characterized in that in stage (b) the diminished particle size biomass is subjected to treatment with a mixture based on caustic soda in the range between 5 and 10% and anthraquinone in the range of 40 to 70 g per liter of solution until obtaining an alkali of 70 in the white liquor and 70% activation, with a liquor: dry fiber ratio by weight between 1.9 and 2.5:1 at pressure between 79 and 101 psig, temperature between 383-403 K during a time of 5 to 125 min.

14. The method of claim 9, further characterized in that in stage (b) the diminished particle size biomass is subjected to treatment with a mixture based on caustic soda in the range between 40 and 70 g/l of solution and Na2S at a concentration of 0.5 to 5 g/l per ton of pulp, with a liquor : dry fiber ratio by weight between 1.9-3.7:1, at pressure between 83 and 105 psig, temperature between 383-403 K during a time of 12 and 125 min.

15. A method for the production of cellulose and hemicellulose fibers from lignocellulosic biomass by applying a differential process comprising the stages of:

a) Diminishing the particle size of the lignocellulosic biomass to a range between 3 and 15 mm, and wherein the lignocellulosic biomass is obtained from sugarcane leaves and buds, b) Treating the diminished particle size biomass with one or more solvents and a mixture of specific catalysts, at a temperature between 383-403 K with a liquor: dry fiber ratio by weight between 1.9-8.5:1 during a time of 5 to 125 min, c) Subjecting the diminished particle size biomass to sudden decompression to atmospheric pressure in a reactor, d) Collecting the material in a cyclone, e) Optionally, treating the solid fraction in a reactor with a mixture of ethanol 40 to 60% w/w referred to the dry fiber and chlorine dioxide 1-5% v/v, f) Washing the solid fraction to achieve cellulose efficiency above 50% and of lignin of 5 to 7%, a fiber length between 1.5 and 1.9 mm; breaking length (km) between 7.0 and 7.5; Burst index (kPam2/g) between 4.5 and 4.9; Tear index (mNm2/g) between 8.3 and 8.7.

* * * * *